United States Patent [19]

Hunter

[11] Patent Number: 4,782,963

[45] Date of Patent: Nov. 8, 1988

[54] CHILD-RESISTANT CONTAINER AND CLOSURE CAP

[76] Inventor: Robert M. Hunter, 320 S. Willson Ave., Bozeman, Mont. 59715

[21] Appl. No.: 113,461

[22] Filed: Oct. 26, 1987

[51] Int. Cl.[4] ..... A61J 1/00; B65D 55/02; B65D 85/56

[52] U.S. Cl. ..... 215/206; 206/534

[58] Field of Search ..... 215/206, 221; 70/232; 206/534

[56] References Cited

U.S. PATENT DOCUMENTS

| | | | |
|---|---|---|---|
| 3,033,406 | 9/1960 | Sauber . | |
| 3,129,834 | 12/1961 | Kimball . | |
| 3,212,662 | 2/1965 | Webb . | |
| 3,402,842 | 2/1967 | Millian . | |
| 3,604,582 | 9/1971 | Boudin . | |
| 3,627,160 | 12/1971 | Horvath . | |
| 3,669,296 | 6/1972 | Drew et al. | 215/206 |
| 3,700,133 | 10/1972 | Bugguley . | |
| 3,703,974 | 11/1972 | Boxer et al. . | |
| 3,771,682 | 11/1973 | Chacos . | |
| 3,782,574 | 1/1974 | Rumble . | |
| 3,828,957 | 8/1974 | Marchant . | |
| 3,843,007 | 10/1974 | Meyer | 215/206 |
| 3,850,324 | 11/1974 | Meyer | 215/206 |
| 3,980,194 | 9/1976 | Costa | 215/223 |
| 4,238,033 | 12/1980 | Artzt | 215/206 |

*Primary Examiner*—George T. Hall

*Attorney, Agent, or Firm*—Dann, Dorfman, Herrell and Skillman

[57] ABSTRACT

A child-resistant container and closure cap combination is provided by using cooperating members on the internal cylindrical sidewalls of the cap and the cylindrical walls of the container neck. The cooperating members are a pair of studs aligned with the axis on one of the cylindrical walls projecting toward the other and three collars supported on the other of said cylindrical walls. The collars have channels through which the studs must pass in placing the cap on the container or removing it and except through those channels the collars block the studs. Two of the three collars are rotatable and the third fixed. Rotation of the cap and container will cause the stud which is positioned between the relatively rotatable collars to contact and drive a stop means on one rotatable collar. By continued rotation the stop, in turn, contacts and drives a drive post on the other rotatable collar. Movement of the drive posts and the stop means causes movement of the rotatable collars and their channels out of alignment with the channel on the fixed collar preventing the cap from being removed from the container. External marks on the cap and container allow a sequence of rotational and counter-rotational movements to established positions which enable realignment of the channels and studs, but any other movement will render the likelihood of such realignment very small.

48 Claims, 2 Drawing Sheets

FIG. 1
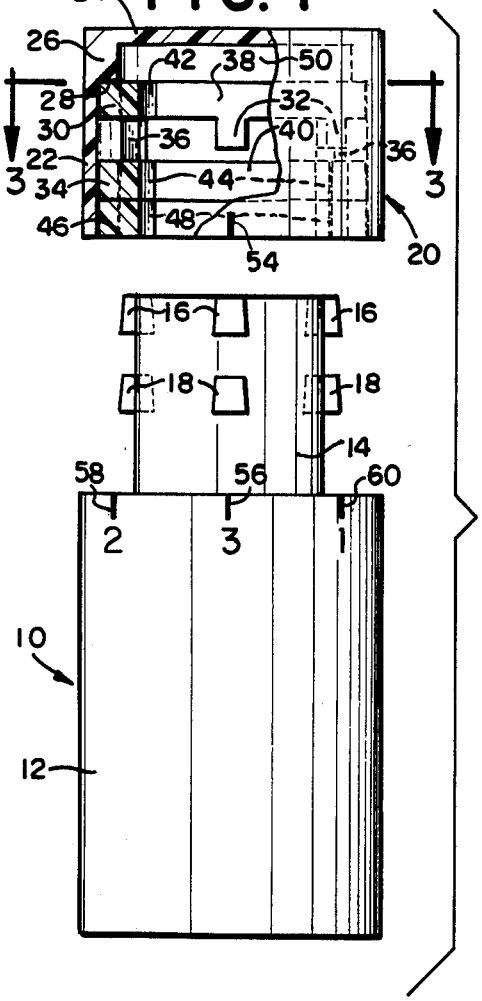
FIG. 2
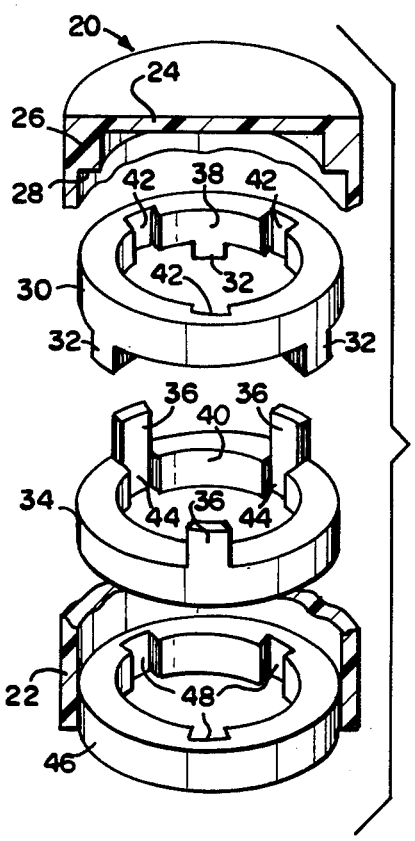
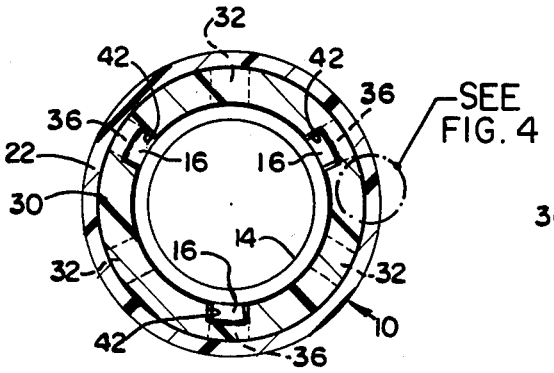
FIG. 3
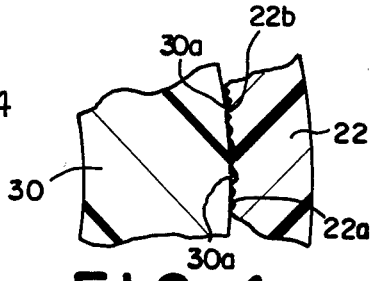
FIG. 4

CHILD-RESISTANT CONTAINER AND CLOSURE CAP

The present invention relates to structures providing child-resistant container and closure cap combinations. In particular the present invention relates to a structure which enables adults to perform a simple combination of moves to remove a cap. Without understanding the pattern, a child will find it difficult to open the container. More specifically, the present invention provides cap and container components Which can be easily manipulated by simple movements into a position in which the cap and container may be separated.

THE STATE OF THE ART

Currently available child-resistant caps may be relatively simple to operate in some cases, but very often require a certain amount of manual dexterity or even strength in one's fingers in order to perform the manipulative step. Commonly such arrangements require relative rotation of a cap to a container and then in a designated place application of force of some type to remove the cap. In some structures of this type even the rotation can be difficult because the structures are not easily rotated. However, in most instances the problem comes with having to use fingers in a way particularly awkward or difficult for older people, or people with some sort of manual disability.

THE NATURE OF THE PRESENT INVENTION

The present invention provides a container which is easier for older people or people with physical disability to open but which is also inexpensive and child resistant.

The preferred embodiment of the invention involves the use of three collars, either supported on the cap or on the neck of a container in a generally cylindrical coaxial relationship. On either the cap or the bottle neck are provided at least a pair of studs aligned in the axial direction. These studs are designed to pass through aligned axial channels on faces of the three collars adjacent to the cylindrical support surface for the studs. In placing the bottle and cap together the studs pass through a collar which is fixed to the cap or the neck of the bottle as the case may be. The studs then pass through axially aligned channels in relatively rotatable members which are preferably held in place between a shoulder and the fixed collar in an axial direction, but are free to move in a rotational direction. The rotatable collars are actually separated in the axial dimension of the second stud by spacer means between the relatively rotatable collars. The spacing function may be performed by separate spacer means but in preferred embodiments is performed by members performing the driving of one or both of the rotatable collars. The stud involved is the second or following stud in the direction of insertion. The first stud passes through one of the rotatable collars, through which only it will pass, into a space beyond all of the collars defined by a shoulder, through which space the stud can rotate freely without interference with any structure associated with a collar. Extending into the space between the collars is at least one stop means on one of the rotatable collars which can be contacted by a rotated stud between the collars and at least one drive post on the other of the rotatable collars. Either the stop means or the drive posts may serve as spacer means or a separate member can serve that function. In this embodiment the drive post serves that function. The drive post cannot be contacted by the stud but will be contacted by the stop means as it is rotated. If either the stop means or the drive posts serve as spacer means or they mutually serve as spacer means, they must be long enough in the axial direction to accomplish the spacing and the spacer means must be sufficient in number and sufficiently widely distributed to provide uniform spacing between the rotatable collars. As a practical matter, all the stop means and drive posts must be uniformly distributed around their respective collars, and, if there are more than one of either, it is desirable that there should be equal numbers of each.

In operation the stud between the collars will drive the stop means rotationally, thus rotating the rotatable collar to which it is affixed. The stop means will strike one of the drive posts after a certain amount of rotation, and, thereafter, continued rotation will cause the second rotatable collar to rotate as well. In this manner, the studs and the two rotatable collars are moved into positions such that the channels in the collars are no longer in alignment as they were when they were inserted. In order to make this operation feasible, the rotatable collars are not left freely to rotate but are provided with some sort of friction means to hold them in position relative to their supporting member except when they are driven directly or indirectly through the stud.

The combination of moving elements makes it highly unlikely that channels could be realigned by random movements. In fact, it requires a sequence of movements, actually four sequential movements, to accomplish re-alignment of the channels. These movements are aided by three marks on one of the relatively rotatable cap or container to be sequentially matched up with a single mark on the other, and the sequence of the matching is preferably indicated at the individual marks. More specifically, the movement involves relative rotation of the cap with respect to the container in one direction to clear or preposition the collars. Then rotation in the other direction back to the first mark will align the channel in one rotatable collar with the channel in the fixed collar. Rotation in the opposite direction will then align the channel in the second rotatable collar with the channels in the other two collars. Finally, rotation back in the reverse direction to the third mark will align channels and the studs so that the cap can be removed easily from the container.

In particular, in that embodiment of the combination of container and closure cap in accordance with the present invention in which the collars are contained within the cap, the following structure is included. The container has a mouth through a neck with a generally cylindrical outer surface, said surface having a pair of axially aligned and spaced stud protrusions from the cylindrical surface near the mouth, one of which is adjacent the mouth. The cap has sidewalls providing a generally cylindrical inner surface and an end wall closing the sidewalls at one end. Shoulder means are fixed to the cap providing a surface spaced from the end wall along the sidewalls limiting the positioning of a collar inserted into the cap. First and second rotatable collars are rotatably supported coaxially within the sidewalls but frictionally engage the sidewalls of the cap so that each collar must be driven to rotate within the cap. Spacer means is provided on at least one of the first and second rotatable collars adapted to space the rotatable collars apart axially at least the distance of the axial extension of the stud on the container neck more remote from the mouth. At least one drive post is supported on one of the rotatable collars sufficiently removed radially from the thickness of the stud to permit rotational passage of the stud in the space between the first and second rotatable collars without contacting the drive post. At least one stop means is provided on the other of the first and second rotatable collars adapted to engage the drive post, or spacer means if the spacer means is also functioning as a drive post, in the course of relative rotation and extending radially sufficiently far to be engaged by the stud on the container neck. Each of the rotatable collars has an axially aligned channel on the inner surface of the collar of sufficient width and sufficient depth in the radial direction to permit the passage of each stud which must pass through it, when the channel members are aligned and the studs are aligned with them. A third fixed collar is fixed to the cap in position to retain the first and second rotatable collars in place within the cap and against the shoulder means. The third fixed collar has an axially extending channel, corresponding to those in the first and second rotatable collars, of sufficient width that when all of the channels are aligned, the studs may pass through the channels as the cap is axially withdrawn from the container.

One mark is provided on one of the cap and container and three marks are provided on the other. Manipulation of the cap and the container in rotational patterns of alternating direction terminating at positions where the three marks in the sequence indicated are matched with the one mark will enable alignment of the channels in the three collars and the studs by interaction between a stud, stop means and drive post. One of the marks matched with the single mark will show the alignment of the rotatable collar carrying the drive posts providing spacer means with the third fixed collar. A second mark aligned with the single mark indicates the alignment of the channel in the rotatable collar carrying the stop means with the channels in the other collars and the third mark matched with the single mark shows the alignment of the studs with the respective channels providing the ability to separate the cap from the container using linear axial movement.

In other embodiments of the invention the collars may be placed on the neck of the container and the studs on the interior surface of the cap as will be illustrated hereafter.

DRAWINGS SHOWING PREFERRED EMBODIMENTS OF THE INVENTION

FIG. 1 illustrates a side elevational view of a container and closure cap according to the present invention with the cap in partial section;

FIG. 2 is an exploded perspective view showing the parts of the cap structure of the embodiment of FIG. 1;

FIG. 3 is a sectional view taken along line 3—3 of FIG. 1;

FIG. 4 is a partial enlarged view showing the detail in the interface between the side wall and the cap;

Figure 5A:
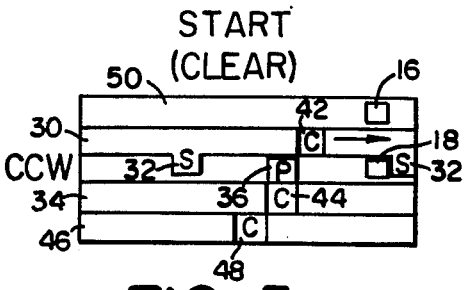
Figure 5B:
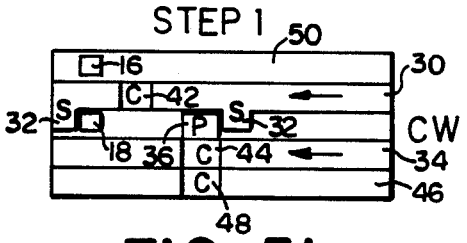
Figure 5C:
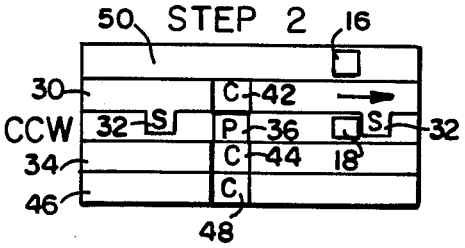
Figure 5D:
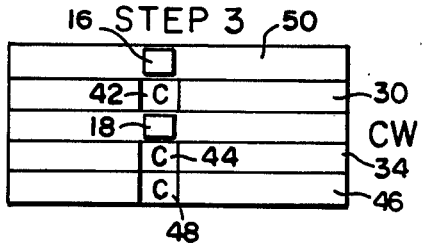
Figure 6:
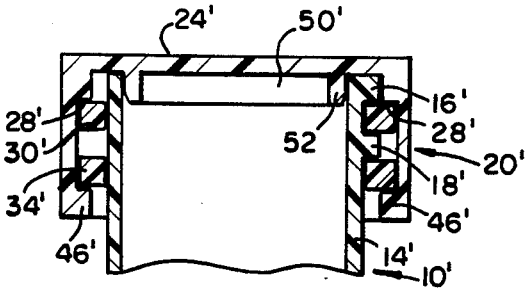
Figure 7:
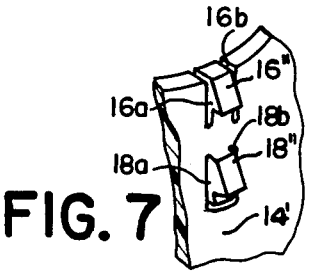

FIGS. 5*a*, 5*b*, 5*c* and 5*d* are a set of four sequential diagrams representing sequential steps in the relative movement of cap and container permitting placement of channels in alignment with each other and with the studs to permit removal of the cap;

FIG. 6 is a sectional view representing a slightly modified structure of the structure of FIGS. 1 through 4, but providing a sealing ring;

FIG. 7 is a detail sectional view showing hinged movable studs; and

Figure 8:
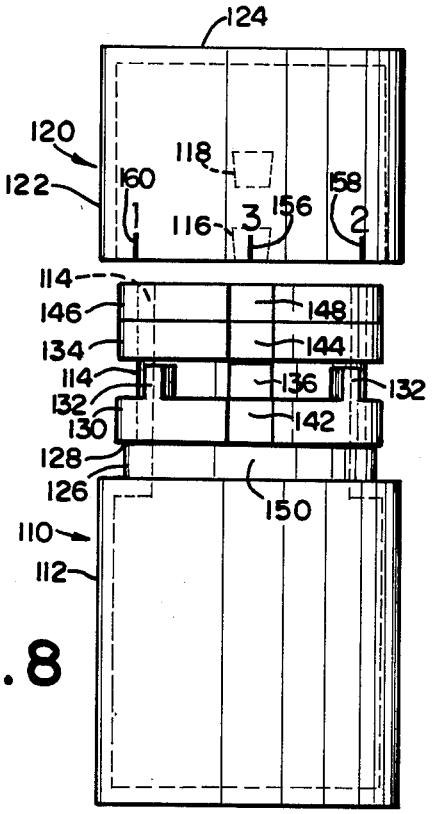

FIG. 8 is a view somewhat similar to that of FIG. 1, but illustrating a varient of the invention.

DETAILED DESCRIPTION OF THE DRAWINGS

Referring first to FIG. 1, there is illustrated a container, generally designated 10, for example, a pill bottle. The body portion of the container may be blow molded or otherwise conventionally fabricated of moldable resinous material and may be of any shape and dimensions provided it is terminated in a neck 14 of fixed cylindrical diameter through which is provided an open mouth access to the body 12 of the container 10. On the outer surface of the neck are molded or otherwise provided studs 16 and 18 which are aligned parallel to the axis and preferably of generally the same size, although they may vary in specific geometry and differ in their axial length.

As represented by the dashed indications of further studs 16 and 18 on the back side of neck 14 as shown in FIG. 1, in this particular embodiment there are three sets of studs 16 and 18 similarly aligned preferably spaced at equal angles around the neck from one another. In other embodiments there might be only one set of studs, or a different number of sets, or a different number of studs in each set, without basically changing the functioning of the device. In cooperation with the three sets of studs 16 and 18, the cap is provided, as will be described, with three sets of channels in corresponding locations through which the studs are designed to pass.

Considering now the cap 20, the structure includes sidewalls 22 and closing end wall 24. The sidewalls provide a generally cylindrical internal surface whose diameter is considerably larger than the diameter of the neck 14 of the container. In this particular embodiment the sidewalls 22 are thickened in the region 26 adjacent the end wall to provide shoulder 28 which acts as a spacer or a stop at least a sufficient distance axially from the end wall greater than the end studs 16 remote from the mouth to accommodate studs 16 in rotational movement above the rotatable collars, when the mouth of neck 14 abuts end wall 24 of the cap. Although the shoulder here is shown to be a continuous circular structure around the top of the cap, the stop function can be served by intermittant, as well as continuous shoulder means. In other embodiments, preferably there should be at least three spaced shoulder members, if their circumferential dimension is relatively small.

For a better understanding of the cooperation between the members comprising the cap reference is made to FIGS. 2, 3 and 4, as well as FIG. 1. FIG. 2 shows the cap structure within in an exploded view so that structure of two rotatable collars 30 and 34, can be seen in greater structural detail. As seen in FIG. 2, this particular embodiment of the invention employs a three stop means 32 on collar 30 equally distributed around the collar. In other embodiments there can be simply one stop means 32 or a different number from three. A stop means need not be of great length, but simply has to extend between rotatable collars 30 and 34 a sufficient distance to be contactable by drive post 36 and by a stud 18 as it moves in the space between the two rotatable collars in the assembly. The upper surface of rotatable collar 30 abuts shoulder 28. The shoulder 28 positions and in assembly limits the inward movement of the rotatable collar 30, the outer diameter of which is preferably snugly engaged within the sidewalls 22 of the cap 20. The second rotatable collar 34 of essentially the same diameter as rotatable collar 30 is held spaced a fixed distance from rotatable collar 30 by a plurality of drive posts 36, which in this embodiment serve also as spacer means, whose length in the axial direction determines the spacing between the rotatable collars 30 and 34. That spacing must be sufficient to allow the studs 18 to pass between the rotatable collars 30 and 34. As studs 18 rotate between collars 30 and 34 they each simultaneously contact one of the stop means 32. Drive posts 36 are radially recessed away from the inner surface of the collar 30 and provide sufficient clearance beyond the outer projection of the studs 18 to allow the studs 18 but not stop means 32 to pass them without interference.

Both of the rotatable collars 30 and 34 are conveniently made of an annular construction with parallel planar upper and lower faces connected by concentric inner and outer concentric cylindrical faces 38 and 40, respectively. Inner cylindrical faces 38 and 40 in rotatable collars 30 and 34 are provided with axially directed channels 42 and 44 parallel to the axis. Channel 44 is of sufficient width to allow the passage of studs 16 and 18. Only studs 16 pass channels 42 which need to be of sufficient width to allow the respective studs 16 to pass axially through those channels. In this particular embodiment, the channels 42 in rotatable collar 30 are spaced intermediate the stop means 32. The channels 44 in rotatable collar 34, however, are coincident with the drive posts 36. Drive posts 36 are advantageously placed at the outer diameter of collar 34 and have a radial thickness corresponding to the radial dimension from the bottom of the channel 44 to the outer surface of the collar 34. Other geometries are possible, provided the inside edges of the drive posts clear the outside surfaces of studs 18. The operation remains unchanged in embodiments which provide one stop means 32 and a plurality of drive posts 36. It is also possible to separate the spacing and driving functions of drive posts 36 on driven rotatable collar 34. For example, a continuous ring at the outside periphery of rotatable collar 34 can act as the spacer provided its inside diameter clears the outside extent of stop means 32. Then inside the spacer ring one or more drive posts which need not extend the full distance between the rotatable collars 30 and 34 permit the rotatable collar 34 to be driven rotationally by stop means 32.

Spacer means and drive posts may not only be different elements fixed to the same collar. The spacer means may be fixed to the collar to which the stop means is affixed or the stop means may be the spacer means instead. In fact, the spacer means may be a separate ring between the two rotatable collars and determine the spacing between them without being fixed to either one and positioned so as not to be driven by either one.

In this particular geometry shown, the cap structure is held together by a final fixed collar 46 fixed to the cap sidewalls by gluing, heat fusing, or otherwise, so that fixed collar 46 forms an integral part of the sidewalls 22. After the assembly has been put in place, the fixed collar 46 holds rotatable collar 34 through its drive posts 36 against rotatable collar 30 which, in turn, abuts but does not press against the shoulder 28. Fixed collar 46 also has three axial channels 48 which are similar to those in the rotatable collars and similarly spaced and which are of a width to pass the studs 16 and 18.

As seen in FIG. 1 in assembly, cap 20 contains the three collars in the compact arrangement shown. Shoulder 28 positions rotatable collar 30 so as to provide space or clearance 50, between rotatable collar 30 and the end wall 24. Space 50 provides sufficient clearance in the axial direction to accommodate studs 16. Drive posts 36 space rotatable collar 34 a sufficient distance away from rotatable collar 30 in the axial direction that the studs 18 can move rotationally within the space between rotatable collars 30 and 34. Fixed collar 46 is fixed to the sidewalls of the cap 20 to hold the assembly together in the axial direction while allowing rotatable collars 30 and 34 to rotate relative to the sidewalls of the cap and relative to one another when actuated by the studs 18, as will be described hereafter.

FIGS. 1, 2 and 3 show the channels in axially aligned position. FIG. 3 is a sectional view taken along line 3,3 of FIG. 1 showing the studs 16 (and 18 below them) aligned with the channels which are shown aligned with one another. In this position, since the channels are aligned and the studs are aligned with them, cap 20 can pass axially down over the neck 14 of the container 10 until the open mouth of the neck contacts the end wall 24 or the axial movement stop means 28 contacts rotatable collar 30. In this position, the studs 16 lie within the space 50 and studs 18 within the space between the collars 30 and 34. The cap then may be rotated relative to the container causing the studs 16 and 18 to moved away from the channels. Such alignment of channels not only permits the engagement of the cap on the container, but when the alignment is reconstructed, allows the cap to be removed from the container. The construction of the invention enables a simple pattern of rotation and counter-rotation to realign the channels and studs. The pattern is easily learned by an adult, but is not obvious to a small child, and the probability of opening by random rotations is extremely small.

FIG. 4 shows one type of construction providing resistance to rotation of the rotatable collars so that a light force must be applied to rotate them with respect to cap 20. Inner surface **22*a* of the sidewalls 22 of the cap 20 is serrated or provided with parallel ribs 22*b* generally parallel to the axis of rotation at least at the levels of rotatable collars 30 and 34. Parallel outwardly extending rounded ribs 30*a* parallel to the axis are provided on the outer surfaces of rotatable collar 30, to act as detents to cooperate with the grooves between parallel ribs 22*b* on the sidewalls. The effect of this arrangement is to cause the rotatable collars to normally maintain their position relative to the cap even though the cap is rotated unless the rotatable collars are subjected to force. Displacing force occurs when a stud 18 located within the spacing between rotatable collars 30 and 34 contacts one of the stop means 32. In the configuration shown, studs will contact all stop means simultaneously. Contact of stop means 32 will overcome the frictional force holding the detents and cause the rotating collar 30 to be displaced relative to the cap 20, when the cap is turned relative to the container. Further rotation will cause the stop means, in turn, to engage one of the drive posts 36, and movement of the drive post will then cause the rotatable collar 34 to be displaced relative to the cap sidewalls 22 when the cap is turned further. It will be appreciated that displacement of the rotatable collars first takes the channels 42, and then takes channels 44, out of alignment with the channels 48 in fixed collar 46**. This process and further random rotation serves the desirable purpose of keeping the cap in place on the container unless and until the channels are realigned in order to remove the cap from the container.

Referring now to FIGS. 5*a*, 5*b*, 5*c* and 5*d* the diagrams shown are entirely schematic and simply representative of sequential steps by which the alignment process proceeds. The diagrams are viewed from a developed section taken along the inside of the cap nearest the viewer in FIG. 1. Although the channels (C) would be on the opposite side and not visible they are shown as though the collars were transparent since understanding their repositioning clarifies the following explanation. In all of the diagrams, the various collars are shown with the same number designators as shown in FIGS. 1 through 3. Alignments occur by turning the container relative to the cap (or cap relative to the container) in four sequential and direction alternating steps. The first diagram marked "start" presumes that the container is turned counterclockwise (when viewed from the top) relative to the cap and will result in stud 18 eventually contacting a stop means 32 and moving rotatable collar 30 the same direction as the stud 18 is moving. Movement continues sufficiently for a stop means 32 to contact and move a drive post 36. Then the process of alignment begins by reversing the direction of rotation of the container to clockwise while holding the cap until the stud 18 strikes the next adjacent stop means 32 and moves the rotatable collar 30 until a stop means 32 engages a drive post 36 thereby moving rotatable collar 34 in the same direction that rotatable collar 30 is being moved. Movement is continued until channel 44 is aligned with channel 48, which point can be recognized by alignment of the mark 60 on the container, here designated 1, opposite a single mark 54 on the cap. Mark 60 is preferaby one of three equally spaced designated marks on the container, which in preferred embodiments may be designated with different designators, conveniently alphabetic designators, which may be a user's initials if he has three different initials. In FIG. 1, however, the single mark 54 is shown on the cap and the three numbered marks are placed on the container. After a complete counterclockwise rotation of the container relative to the cap, the cap is rotated clockwise until the mark 54 is stopped opposite the 1 mark. At that point, the direction of rotation of the container 10 is again reversed to the counterclockwise direction while holding the cap until the mark 58, designated 2, is opposite the same mark 54 on the cap. As the counterclockwise rotation occurs, the stud 18 strikes stop means 32 driving it away from drive posts 36 to a point intermediate the drive posts. As the mark 54 and the mark 58 are aligned, the channel 42 in collar 30 is aligned with channels 44 and 48. All that remains is to move the container in the clockwise direction relative to the held cap once again until the mark 56 on the bottle designator, is opposite the same mark 54 on the cap. At this point the studs 16 and 18 line up with the aligned channels 42, 44 and 48 and the cap can be removed by an axial movement. In order to accomplish this procedure, the external marks need to be provided on the cap and the container respectively, although the numbered or lettered markings can be rearranged and placed on the cap to be matched with a mark on the container.

FIG. 6 shows a variation of the structure shown in FIGS. 1 through 4. Therefore, similar parts have been designated by similar number designators with the addition of primes thereto. The structure is essentially the same except that there is added a tubular extension 52 which projects downwardly within the open mouth of the neck 14' when the cap is in place on the container. The tubular extension 52 cooperates with the inside of neck 14' to prevent the contents of the container from leaking out around the neck under the cap.

FIG. 7 is a partial sectional view taken through one side of the neck of a modified container 10'' of the type shown in FIG. 1. This view illustrates a modification to the studs 16'' and 18'' of the container neck 14'' wherein the studs are hingedly supported by providing cuts alongside each stud. Studs 18'' are each provided with a U-shaped cut **18*a* which allows the stud 18'' to be depressed inwardly to a position inside the neck sidewalls 14. Similarly each stud 16'' has two parallel cuts 16*a* and 16*b* at its edges which extend from the mouth of the neck to well below the stud to allow the stud to be depressed inside the sidewalls of the neck. This structure allows the collars on the cap 20 to depress the studs inwardly as the cap 20''** is placed over the neck and moved axially into closed position. The studs themselves are tapered outwardly from top to bottom to allow for a cam action by the collars on the studs. The resilience of the material selected for the container then causes them to reposition into the positions shown in FIG. 1 overlying the respective collars. The dam orientation does not permit axial movement in the other direction to remove the cap without alignment of the channels with the studs but does permit quick recapping.

Other forms of movable studs to permit putting a cap in place but prevent its removal without the channel orientation procedure will occur to those skilled in the art. For example, preferred devices for some applications would include studs which fold or retract into the wall without penetrating the wall.

Finally, reference is made to FIG. 8. FIG. 8 illustrates a reversed structure in which the collars are mounted on the neck of the container instead of the cap. In this case, the studs are placed within the cap on the inside sidewalls 122 thereof. Here corresponding numbers with a preceding one in the hundreds digit position are used to show corresponding parts or parts that have close correspondence functionally, although they may not be the same exactly. More specifically, in this case cap 120 has sidewalls 122 and an end closure 124. The cap carries no structure other than studs 116 and 118, again shown in three identically aligned positions 120° apart. The studs are numerically reversed, as are the rotatable collars, since the first to enter the channels is stud 116 just as stud 16 was the first to enter the channels in FIGS. 1–3.

On the container 110 the body 112 of the container 110 remains essentially unchanged, but the neck 114 is provided with an enlarged diameter portion 126 to provide shoulder 128 which acts to position the rotatable collar 130 around neck 114 spaced from the container 110 in order to provide at least a sufficiently long space 150 axially to accommodate stud 116. Rotatable collar 130 has channel 142 parallel to the axis in its outer surface. Rotatable collar 130 could either be provided with stop means or spacer drive posts, and, whichever it did not have, rotatable collar 134 would be provided with. Either the drive posts or the stop means could serve as spacer means or a separate spacer means such as a thin ring separate from both collars could be used very close to the neck and with both drive posts and stop means. The stop means 132 are on rotatable collar 130 and the drive posts 136, which also serve as spacer means, on rotatable collar 134 as shown in the pictured embodiment so that rotatable collars 130 and 134 are spaced apart a sufficient distance in the axial direction to accommodate stud 118. Rotatable collar 134 provides channel or channels 144 in rotatable collar 134 and rotatable collars 130 and 134 are, in turn, held in place axially against shoulder 128 by fixed collar 146 which is put in place and fixed to the neck 114 of the container. Thus its channel 148 remains in fixed position relative to the container at all times.

The action is essentially the same as it is in the structure of the FIGS. 1-3 embodiment except that the studs are on the cap and move the rotatable collars around the neck of the container. Stud 118 specifically does this by engaging the stop means 122 which, in turn, engage the drive posts 136 to move the respective rotatable collars to which they are attached. Alignment of the channels involves a process analogous to that employed in aligning the FIGS. 1-3 embodiment shown in FIGS. *5a, 5b, 5c* and *5d.*

From what has been shown, it will be clear to those skilled in the art that, even within the bounds of the invention as illustrated, a single stop means can be used or a plurality of stop means, only one of which interfere with the stud so that, with a single stop means, a complete rotation is necessary instead of 120° maximum in order to clear and start the alignment procedure. The drive posts and stop means are interchangable on the collars. The spacer function may be shared between them, accomplished by either separately, or accomplished by a spacer means not part of either rotatable collar.

It will also be clear to those skilled in the art that means to indicate the correct combination of movements needed to unlock the closure other than marks on the container and the cap may be provided. The indication may be to any of man's senses and may not be a visual indication. Such means may also provide a warning that the closure is unlocked or a separate warning means may be provided.

An example of a warning means for the embodiment shown in FIG. 1 would be a slot (not shown in FIG. 1 because that part of the cap is not shown) in the cap 20 extending in the axial direction from just above a channel 48 in the fixed collar 46 to just below the shoulder 28. The slot would have a width in the cap circumferential direction less than the width of the studs 18 in that direction. When the closure was in the unlocked condition, a red coloration provided on the outer surface of the studs 18, on the exterior surface of the rotatable collars 30 and 34 over (i.e., exterior to) the location of the channels 42 and 44 and on the exterior surface of the spacer means 36 would show through the slot as an unbroken red line warning the user of the danger.

Many variations in configurations have been discussed and others will occur to those skilled in the art. Some variations within the scope of the claims include such devices as linear rather than rotational moving locking parts. Other variations within the scope of the claims include such devices wherein alignment of openings in the moving locking parts with an opening in the container allows access to container contents without the need for physical separation of the cap from the container. All such variations within the scope of the claims are intended to be within the scope and spirit of the present invention.

I claim:

1. A child resistant container and closure cap comprising two elements:

a container having an opening through a neck; and a closure cap conforming to said neck fastenable over the opening;

one of said two elements having at least two parts movable relative to that element and at least one interfering part of the other element engagable by at least one of the movable parts to prevent separation of the elements in all but at least one selected relative position in which at least one unlocked position of the movable parts allows separation.

2. The child resistant container and closure cap of claim 1 in which the plurality of movable parts are movably attached to one element and provided with means to interact with one another to achieve movement to the unlocked position.

3. The child resistant container and closure cap of claim 2 in which means of movement of only one of the relatively movable parts including the supporting element is provided enabling in a sequence of movements in alternating directions of that one part to predetermined positions relative to the other parts to achieve the unlocked position.

4. The child resistant container and closure cap of claim 2 in which the element to which the plurality of movable parts are attached is the one which is moved relative to the other movable parts, which movement causes interaction with the movable parts to achieve the unlocked position.

5. The child resistant container and closure cap of claim 4 in which a fixed sequence of movement of the cap and container in alternating directions is necessary to achieve unlocked position.

6. A child resistant container and closure cap in accordance with claim 5 in which indicia are provided on the cap and the container to define limits of relative movement of the cap with respect to the container.

7. In combination a container and a closure cap requiring systematic rotational patterns to open comprising:

a container having a mouth through a neck providing a cylindrical outer surface;

at least one set of at least two spaced studs protruding from the cylindrical surface of the neck aligned along the neck parallel to the axis;

a cap having sidewalls providing a cylindrical inner surface having an end wall closing the sidewalls at one end and shoulder means fixed to the cap spaced from the sidewalls so as to interfere with rotation of a neck having a stud at the same axial level and from the end wall along the sidewalls a sufficient distance to include the first stud closest to the mouth when the neck is fully inserted into the cap;

the same number of rotatable collars as there are studs in each set, the rotatable collars coaxially received and rotatably supported within the sidewalls and frictionally engaging the cap so that each rotatable collar normally moves the cap, each of said rotatable collars having an axially aligned channel on the inner surface of the rotatable collar of sufficient width in the circumferential direction and sufficient depth in the radial direction to permit the passage of each stud which must pass through that channel when the channel members are aligned and the studs aligned with them, the collars being sufficiently closely spaced to the neck that the studs cannot pass the collars except through the channels;

spacer means between the rotatable collars, the spacer means being adapted to space the rotatable collars apart axially at least the distance of the axial extension of the studs on the container neck other than the first;

at least one drive post on the number of rotatable collars minus one sufficiently removed radially from the thickness of the stud to permit rotational passages of the stud between the rotatable collars and past the drive posts;

stop means on the other rotatable collars adapted to engage the drive posts in the course of relative rotation of the rotatable collars and extending radially inwardly sufficiently far to be engaged by a stud on the container neck;

a fixed collar fixed to the cap in position to retain the rotatable collars in place within the cap and abutting the shoulder means, said fixed collar having a channel of sufficient width to allow passage of the studs when all channels are aligned with the studs so that studs may pass through the channel as the cap is axially withdrawn; and marks on the cap and the container, including one mark on one and a number of marks on the other equal to the number of rotatable collars plus one, circumferentially distributed on the other, whereby rotational patterns of alternating direction enable realignment of the channels in the rotatable and fixed collars by interaction between the stud, the stop means and the drive posts, such that alignment of each one of the number of marks, other than the last mark, shows alignment of a channel on a rotatable collar with the channel of the fixed collar, and alignment of the last of the number of marks with the one mark shows the alignment of the studs with the aligned channels.

8. The combination of claim 7 in which studs are arranged with cam-like surfaces and structure enabling them to retract into their supporting surface to allow axial passage of the collars in closure of the cap to the container but do not yield when the cap is attempted to be removed from the container.

9. In combination a container and a closure cap requiring systematic rotational patterns to open comprising:

a container having a mouth through a neck providing a cylindrical outer surface;

a cap having sidewalls providing a cylindrical inner surface having an end wall closing the sidewalls at one end such that the cylindrical inner surface of the sidewalls are spaced from the outer cylindrical surface of the container neck;

one of the cylindrical surfaces supporting at least one pair of spaced first and second studs aligned parallel to the axis protruding from that cylindrical surface toward the other;

the other cylindrical surface providing a shoulder means axially indexing first and second rotatable collars coaxially rotatably supported on said cylindrical surface, the first and second rotatable collars frictionally engaging the supporting cylindrical surface so that each rotatable collar normally moves with that cylindrical surface, each of said collars having an axially aligned channel in the surface opposite the collar supporting surface of sufficient width in the circumferential direction and sufficient depth in the radial direction to permit the passage of each stud which must pass through that channel when the channel members are aligned and the studs aligned with them, the collars being sufficiently closely spaced to the supporting cylindrical surface that the studs cannot pass the collars except through the channels;

spacer means between the rotatable collars to space the rotatable collars apart axially at least the distance of the axial extension of the second stud;

at least one drive post on one of the rotatable collars sufficiently removed radially from the thickness of the stud to permit rotational passage of the stud between the rotatable collars and past the drive post;

stop means on the other of the rotatable collars adapted to engage the at least one drive post in the course of relative rotation of the rotatable collars and extending radially sufficiently far to be engaged by a relatively rotating stud; and a third fixed collar fixed to the collar supporting cylindrical surface in position to retain the first and second rotatable collars in place abutting the shoulder means, said third fixed collar having a channel of sufficient width to allow passage of the studs when all channels are aligned with the studs so that the studs may pass through the channel as the cap is axially withdrawn.

10. The combination of claim 9 in which studs are arranged with cam-like surfaces and structure enabling them to retract into their supporting surface to allow axial passage of the collars in closure of the cap to the container but do not yield when the cap is attempted to be removed from the container.

11. In combination a container and a closure cap requiring systematic rotational patterns to open comprising:

a container having a mouth through a neck providing a cylindrical outer surface, said surface having at least one pair of spaced first and second studs protruding from the cylindrical surface aligned along the neck parallel to the axis;

a cap having sidewalls providing a cylindrical inner surface having an end wall closing the sidewalls at one end and shoulder means fixed to the cap spaced from the cap sidewalls so as not to interfere with rotation of a stud at the same axial level and spaced from the end wall along the sidewalls a sufficient distance to include the first stud closest to the mouth when the neck is fully inserted into the cap:

first and second rotatable collars coaxially received and rotatably supported within the sidewalls and frictionally engaging the cap so that each rotatable collar normally moves with the cap, each of said collars having an axially aligned channel on the inner surface of the collar of sufficient width in the circumferential direction and sufficient depth in the radial direction to permit the passage of each stud which must pass through that channel when the channel members are aligned and the studs aligned with them, the collars being sufficiently closely spaced to the neck that the studs cannot pass the collars except through the channels; spacer means between the rotatable collars to space the rotatable collars apart axially at least the distance of the axial extension of the second stud on the container neck;

at least one drive post on one of the first and second rotatable collars sufficiently removed radially from the thickness of the stud to permit rotational passage of the stud between the rotatable collars and past the drive post;

stop means on the other of the first and second rotatable collars adapted to engage the at least one drive post in the course of relative rotation of the rotatable collars and extending radially inwardly sufficiently far to be engaged by a stud on the container neck; and a third fixed collar fixed to the cap in position to retain the first and second rotatable collars in place within the cap and abutting the shoulder means, said third fixed collar having a channel of sufficient width to allow passage of the studs when all channels are aligned with the studs so that studs may pass through the channel as the cap is axially withdrawn.

12. In combination a container and a closure cap requiring systematic rotational patterns to open comprising:

a container having a mouth through a neck providing a cylindrical outer surface;

a cap having sidewalls providing a cylindrical inner surface having an end wall closing the sidewalls at one end such that the cylindrical inner surface of the sidewalls are spaced from the outer cylindrical surface of the container neck;

one of the cylindrical surfaces supporting at least one pair of spaced first and second studs aligned parallel to the axis protruding from that cylindrical surface toward the other;

the other cylindrical surface providing a shoulder means axially indexing first and second rotatable collars coaxially rotatably supported on said cylindrical surface, the first and second rotatable collars frictionally engaging the supporting cylindrical surface so that each rotatable collar normally moves with that cylindrical surface, each of said collars having an axially aligned channel in the surface opposite the collar supporting surface of sufficient width in the circumferential direction and sufficient depth in the radial direction to permit the passage of each stud which must pass through that channel when the channel members are aligned and the studs aligned with them, the collars being sufficiently closely spaced to the supporting cylindrical surface that the studs cannot pass the collars except through the channels;

spacer means between the rotatable collars to space the rotatable collars apart axially at least the distance of the axial extension of the second stud;

at least one drive post on one of the rotatable collars sufficiently removed radially from the thickness of the stud to permit rotational passage of the stud between the rotatable collars and past the drive post;

stop means on the other of the rotatable collars adapted to engage the at least one drive post in the course of relative rotation of the rotatable collars and extending radially sufficiently far to be engaged by a relatively rotating stud;

a third fixed collar fixed to the collar supporting cylindrical surface in position to retain the first and second rotatable collars in place abutting the shoulder means, said third fixed collar having a channel of sufficient width to allow passage of the studs when all channels are aligned with the studs so that the studs may pass through the channel as the cap is axially withdrawn; and marks on the cap and container, including one mark on one and three marks circumferentially distributed on the other, whereby rotational patterns of alternating direction enable realignment of the channels in the three collars by interaction between the stud, the stop means and the at least one drive post, such that alignment of one of the three marks with the one mark shows the alignment of the channel of the rotatable collar carrying the drive post with the channel of the third fixed collar, alignment of the second of the three marks with the one mark shows the further alignment of the channel of the rotatable collar carrying the stop means with the other channels, and alignment of the third of the three marks with the one mark shows the alignment of the studs with the aligned channels.

13. In combination a container and a closure cap requiring systematic rotational patterns to open comprising:

a container having a mouth through a neck providing a cylindrical outer surface, said surface having at least one pair of spaced first and second studs protruding from the cylindrical surface aligned along the neck parallel to the axis;

a cap having sidewalls providing a cylindrical inner surface having an end wall closing the sidewalls at one end and shoulder means fixed to the cap spaced from the cap sidewalls so as not to interfere with rotation of a stud at the same axial level and spaced from the end wall along the sidewalls a sufficient distance to include the first stud closest to the mouth when the neck is fully inserted into the cap;

first and second rotatable collars coaxially received and rotatably supported within the sidewalls and frictionally engaging the cap so that each rotatable collar normally moves with the cap, each of said collars having an axially aligned channel on the inner surface of the collar of sufficient width in the circumferential direction and sufficient depth in the radial direction to permit the passage of each stud which must pass through that channel when the channel members are aligned and the studs aligned with them, the collars being sufficiently closely spaced to the neck that the studs cannot pass the collars except through the channels, spacer means between the rotatable collars to space the rotatable collars apart axially at least the distance of the axial extension of the second stud on the container neck;

at least one drive post on one of the first and second rotatable collars sufficiently removed radially from the thickness of the stud to permit rotational passage of the stud between the rotatable collars and past the drive post;

stop means on the other of the first and second rotatable collars adapted to engage the at least one drive post in the course of relative rotation of the rotatable collars and extending radially inwardly sufficiently far to be engaged by a stud on the container neck;

a third fixed collar fixed to the cap in position to retain the first and second rotatable collars in place within the cap and abutting the shoulder means, said third fixed collar having a channel of sufficient width to allow passage of the studs when all channels are aligned with the studs so that studs may pass through the channel as the cap is axially withdrawn; and marks on the cap and container, including one mark on one and three marks circumferentially distributed on the other, whereby rotational patterns of alternating direction enable realignment of the channels in the three collars by interaction between the stud, the stop means and the at least one drive post, such that alignment of one of the three marks with the one mark shows the alignment of the channel of the rotatable collar carrying the drive post with the channel of the third fixed collar, alignment of the second of the three marks with the one mark shows the further alignment of the channel of the rotatable collar carrying the stop means with the other channel, and alignment of the third of the three marks with the one mark shows the alignment of the studs with the aligned channels.

14. In combination a container and a closure cap requiring systematic rotational patterns to open comprising:

a container having a mouth through a neck providing a cylindrical outer surface;

a cap having sidewalls providing a cylindrical inner surface having an end wall closing the sidewalls at one end such that the cylindrical inner surface of the sidewalls are spaced from the outer cylindrical surface of the container neck;

one of the cylindrical surfaces supporting at least one set of at least two spaced studs aligned parallel to the axis protruding from that cylindrical surface toward the other;

the other cylindrical surface providing a shoulder mean axially indexing the same number of rotatable collars as there are studs in each set, the rotatable collars rotatably supported on said cylindrical surface and frictionally engaging the supporting cylindrical surface so that each rotatable collar normally moves with that cylindrical surface, each of said rotatable collars having an axially aligned channel in the surface opposite the rotatable collar supporting surface of sufficient depth in the radial direction to permit the passage of each stud which must pass through that channel when the channel members are aligned and the studs aligned with them, the rotatable collars being sufficiently closely spaced to the supporting cylindrical surface that the studs cannot pass the collars except through the channels;

spacer means between the rotatable collars, the spacer means being adapted to space the rotatable collars apart axially at least the distance of the axial extension of the studs other than the first;

at least one drive post on the number of rotatable collars minus one sufficiently removed radially from the thickness of the stud to permit rotational passage of the stud between the rotatable collars and past the drive posts;

stop means on the other rotatable collars adapted to engage the drive posts in the course of relative rotation of the rotatable collars and extending radially sufficiently far to be engaged by relatively rotating stud;

a fixed collar fixed to the rotatable collar supporting cylindrical surface in position to retain the rotatable collars in place abutting the shoulder means, said fixed collar having a channel of sufficient width to allow passage of the studs when all channels are aligned with the studs so that studs may pass through the channel as the cap is axially withdrawn; and marks on the cap and the container, including one mark on one and a number of marks on the other equal to the number of rotatable collars plus one, circumferentially distributed on the other, whereby rotational patterns of alternating direction enable realignment of the channels in the rotatable and fixed collars by interaction between the stud, the stop means and the drive posts, such that alignment of each one of the number of marks, other than the last mark, shows alignment of a channel on a rotatable collar with the channel of the fixed collar, and alignment of the last of the number of marks with the one mark shows the alignment of the studs with the aligned channels.

15. The combination of claim 13 in which a plurality of drive posts are employed on the same rotatable collar equally spaced around their supporting collars.

16. The combination of claim 14 in which the drive posts act as the spacer means and contact the adjacent rotatable collar.

17. The combination of claim 16 in which only one stop means is provided to interfere with the drive posts.

18. The combination of claim 13 in which a plurality of stop means are provided equally spaced around the rotatable collar supporting the stop means.

19. The combination of claim 16 in which a plurality of stop means are provided equally spaced around the collar supporting the stop means.

20. The combination of claim 13 in which equal numbers of pairs of studs and channels are provided equally spaced around their respective supporting structures.

21. The combination of claim 19 in which equal numbers of pairs of studs and channels are provided equally spaced around the supporting structures.

22. The combination of claim 19 in which three pairs of studs and three sets of channels are provided and three stops and three drive posts, each equally spaced around their supporting rotatable collars but with the drive posts positions staggered relative to the stop means positions to with respect to the channel locations.

23. The combination of claim 13 in which additional aligned pairs of studs are provided on the neck and corresponding numbers of additional channels are provided on the respective collars such that the studs and the channels are equally spaced around the circumference of the respective collars and positioned to be alignable with one another.

24. The combination of claim 13 in which the spacer means on one of the rotatable collars is provided by drive posts at equal angular spacings around the collar mounted on one rotatable collar and contacting the other.

25. The combination of claim 24 in which only one stop means is provided to interfere with the drive posts.

26. The combination of claim 24 in which an equal number of stop means to the number of drive posts is provided evenly spaced on the other rotatable collar.

27. The combination of claim 13 in which friction means between the rotatable collars and sidewalls include a serrated surface on one of the opposed surfaces of the relatively rotatable members providing essentially equally spaced ribs axially parallel to one another and suitable detent means engaging the serrations on the opposed surface of the other relatively rotatable member.

28. The combination of claim 27 in which the serrated surface is provided on the sidewalls of the cap and detent means engaging the serrated means is provided on the rotatable collar, the ribs of the serrations being at least sufficiently flexible to yield under pressure to release the detent.

29. The combination of claim 13 in which the cap supports from its end wall a tubular extension having a cylindrical outer surface which is snugly received within the neck.

30. In combination a container and a closure cap requiring systematic rotational patterns to open comprising:

a cap having sidewalls providing a generally cylindrical inner surface, said surface having at least one pair of spaced first and second studs protruding from the cylindrical cap sidewalls aligned and spaced radially inwardly along an element of the cap sidewalls parallel to the axis;

a container having a mouth through a neck with a generally cylindrical outer surface and shoulder means of somewhat greater diameter than the neck fixed to the container spaced from the mouth so as not to interfere with rotation of a cap having a stud at the same axial level and spaced away from the mouth a sufficient distance to include the first stud further from the mouth when the neck is fully inserted into the cap;

first and second rotatable collars coaxially received and rotatably supported around the neck and frictionally engaging the neck so that each rotatable collar normally moves with the container, each of said collars having an axially aligned channel on the outer surface of the collar of sufficient width in the circumferential direction and sufficient depth in the radial direction to permit the passage of each stud which must pass through the channel when the channel members are aligned and the studs aligned with them and otherwise being sufficiently close spaced to the cap sidewalls that the studs cannot pass the collars except through the channel;

spacer means between the first and second rotatable collars, the spacer means being adapted to space the rotatable collars apart axially at least the distance of the axial extension of the second stud on the container neck;

at least one drive post on one of the first and second rotatable collars sufficiently removed radially from the thickness of the stud to permit rotational passage of the stud between the rotatable collars and past the drive post;

at least one stop means on the other of the first and second rotatable collars adapted to engage the at least one drive post in the course of relative rotation of the rotatable collars and extending radially outwardly sufficiently far to be engaged by a stud on the sidewall of the cap;

a third fixed collar fixed to the neck near to the mouth in position to retain the first and second rotatable collars in place on the neck and abutting the shoulder means, said third fixed collar having a channel of sufficient width to allow passage of studs when all channels are aligned with the studs so that the studs may pass through the channels as the cap is axially withdrawn from the containers; and marks on the cap and container, including one mark on one and three marks circumferentially distributed on the other, whereby rotational patterns of alternating direction enable realignment of the channels in the three collars by interaction between the stud, the stop means and the at least one drive post, such that alignment of one of the three marks with the one mark shows the alignment of the channel of the rotatable collar carrying the drive post with the channel of the third fixed collar, alignment of the second of the three marks with the one mark shows the further alignment of the rotatable channel of the collar carrying the stop means with the other channel, and alignment of the third of the three marks with the one mark shows the alignment of the studs with the aligned channels.

31. The combination of claim 30 in which a plurality of drive posts are employed on the same rotatable collar equally spaced around their supporting collar.

32. The combination of claim 31 in which the drive posts act as the spacer means and contact the adjacent rotatable collar.

33. The combination of claim 30 in which a plurality of stop means are provided equally spaced around the rotatable collar supporting the stop means.

34. The combination of claim 32 in which a plurality of stop means are provided equally spaced around the rotatable collar supporting the stop means.

35. The combination of claim 30 in which equal numbers of pairs of studs and channels are provided equally spaced around their respective supporting structures.

36. The combination of claim 34 in which equal numbers of pairs of studs and channels are provided equally spaced around the supporting structures.

37. The combination of claim 36 in which three pair of studs and channels are provided and three stop means and three drive posts equally spaced around their supported collars with stop means staggered relative to the drive posts and with respect to the channel locations.

38. The combination of claim 30 in which additional aligned pairs of studs are provided on the neck and corresponding numbers of additional channels are provided on the respective collars such that the studs and the channels are equally spaced around the circumference of the respective members and positioned to be alignable with one another.

39. The combination of claim 30 in which the spacer means on one of the rotatable collars is provided by drive posts at equal angular spacings mounted on one rotatable collar and contacting the other.

40. The combination of claim 39 in which only one stop means is provided to interfere with the drive posts.

41. The combination of claim 39 in which an equal number of stop means to the number of drive posts is provided evenly spaced on the respective rotatable collars.

42. The combination of claim 30 in which friction means between the rotatable collars and sidewalls include a serrated surface on one of the opposed surfaces of the relatively rotatable members providing essentially equally spaced ribs axially parallel to one another and suitable detent means engaging the serrations on the opposed surface of the other relatively rotatable member.

43. The combination of claim 42 in which the serrated surface is provided on the sidewalls of the cap and detent means engaging the serrated means is provided on the rotatable collar, the ribs of the serration being at least sufficiently flexible to yield under pressure to release the detent.

44. The combination of claim 30 in which the cap supports from its end wall a tubular extension having a cylindrical outer surface which is snugly received within the neck.

45. The combination of claim 1 further comprising warning means whereby the unlocked condition of the movable parts is revealed to the user.

46. The combination of claim 1 further comprising sealing means fixed to at least one of said elements whereby a seal is established between said two elements when the closure cap is locked over the container opening.

47. The combination of claim 13 provided with a warning means comprising a cap sidewall having a slot, the slot having a width in the cap circumferential direction that is less than the width of the studs in that direction and said slot extending in the cap axial direction from just above a channel in the fixed collar to just below the shoulder, and red coloration on the outer surface of the studs at greatest distance from the mouth, on the exterior surface of the rotatable collars over the location of the channels, and on the exterior surface of the spacer means.

48. A child resistant container and closure cap comprising two elements:

a container having an opening through a neck; and a closure cap conforming to said neck fastenable over the opening;

one of said two elements having at least two parts movable relative to that element and at least one interfering part of the other element engagable by at least one of the movable parts to prevent access to the opening in the container in all but at least one selected relative position in which at least one unlocked position of the movable parts allows access.

* * * * *

UNITED STATES PATENT AND TRADEMARK OFFICE

CERTIFICATE OF CORRECTION

PATENT NO. : 4,782,963

DATED : November 8, 1988

INVENTOR(S) : Robert M. Hunter

It is certified that error appears in the above-identified patent and that said Letters Patent is hereby corrected as shown below:

Column 1, line 12, "Which" should read --which--.

Column 8, line 23, "dam" should read --cam--.

Column 9, line 13, "122" should read --132--.

Signed and Sealed this

Fifteenth Day of August, 1989

*Attest:*

*Attesting Officer*

DONALD J. QUIGG

*Commissioner of Patents and Trademarks*